United States Patent [19]

Girodin

[11] 4,166,398

[45] Sep. 4, 1979

[54] MULTI-CYLINDER MACHINES

[76] Inventor: Marius G. H. Girodin, "La Fontaine Peureuse", 78580 Bazemont, France

[21] Appl. No.: 529,217

[22] Filed: Dec. 3, 1974

[30] Foreign Application Priority Data

Dec. 5, 1973 [FR] France ..... 73 43417

[51] Int. Cl.[2] ..... F16H 23/00

[52] U.S. Cl. ..... 74/60; 123/58 B

[58] Field of Search ..... 74/60; 91/491; 123/58 B

[56] References Cited

U.S. PATENT DOCUMENTS

| | | | |
|---|---|---|---|
| 2,028,557 | 1/1936 | Nevatt | 74/60 |
| 2,097,138 | 10/1937 | Steele | 123/58 B |
| 2,105,019 | 1/1938 | Turner | 74/60 |
| 3,398,699 | 8/1968 | Stark | 74/60 |

FOREIGN PATENT DOCUMENTS

| | | | |
|---|---|---|---|
| 827441 | 1/1952 | Fed. Rep. of Germany | 74/60 |
| 517852 | 12/1920 | France | 74/60 |

*Primary Examiner*—Samuel Scott
*Assistant Examiner*—Wesley S. Ratliff, Jr.
*Attorney, Agent, or Firm*—Lewis H. Eslinger

[57] ABSTRACT

A multi-cylinder machine comprises a plurality of cylinders arranged in a casing symmetrically around an axis of rotation with the axes of the cylinders lying parallel to the axis of rotation. Pistons of the cylinders are connected to a common motion transmitting mechanism by means of piston rods. The mechanism comprises an oblique crankshaft and a motion transmitting element including a ring gear in mesh with a ring gear rigid with the casing. At least one of the components of the transmitting mechanism comprises detachable parts.

7 Claims, 3 Drawing Figures

Fig:1
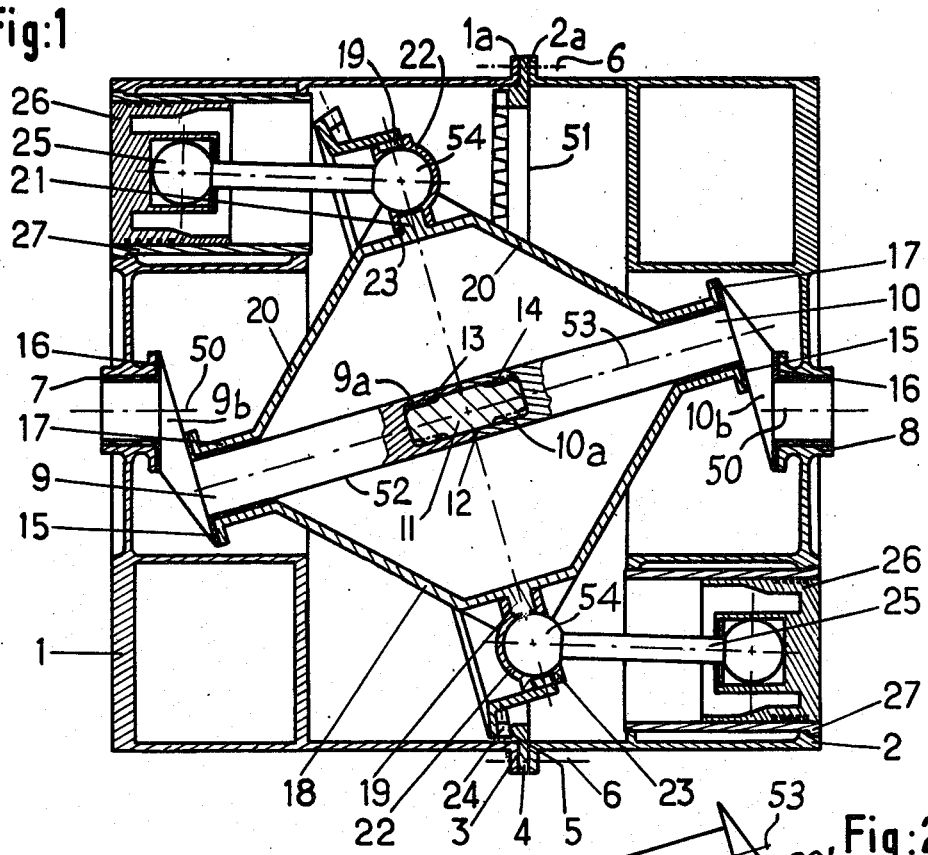
Fig:2
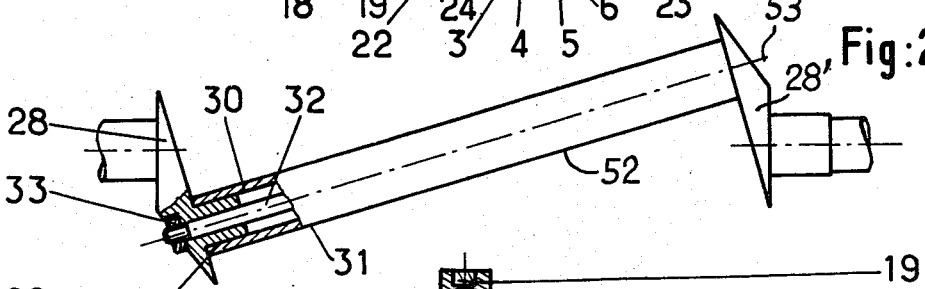
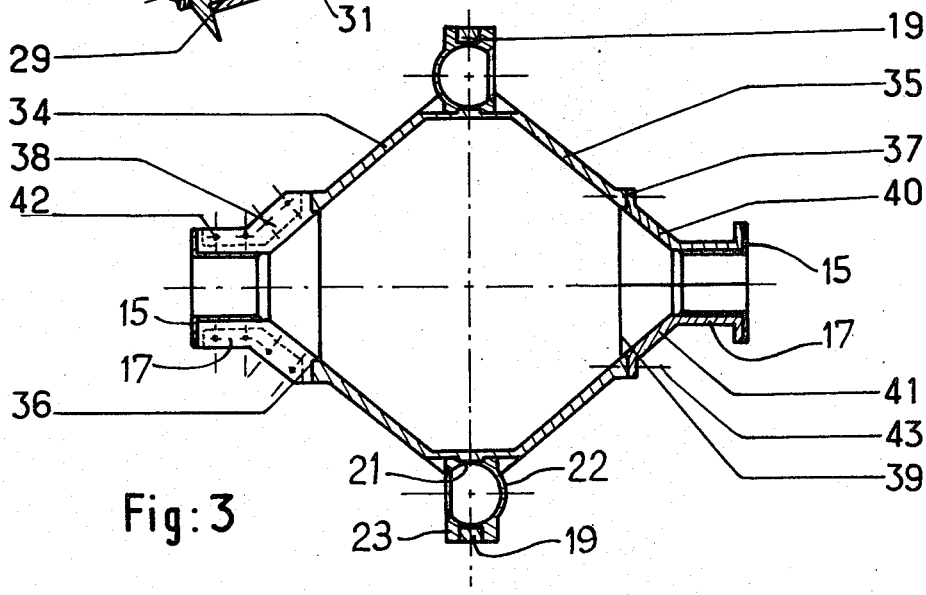
Fig:3

MULTI-CYLINDER MACHINES

BACKGROUND OF THE INVENTION

1. Field of the Invention

The present invention relates to multi-cylinder machines, for example engines, pumps, or compressors.

2. Description of the Prior Art

Multi-cylinder machines have been proposed, for example in U.S. Pat. No. 3,198,022, comprising parallel cylinders arranged symmetrically around an axis. The pistons of the cylinders are connected to a common motion transmitting a mechanism comprising a generally "Z" shaped crankshaft rotatable about said axis and having an oblique spindle, and a motion transmitting element.

An object of the present patent is to provide a machine of this type which is relatively easy to produce and which is reliable in operation.

SUMMARY OF THE INVENTION

According to the present invention, there is provided in a machine comprising a casing, a plurality of cylinders carried by said casing, said cylinders extending parallel to an axis of rotation and being positioned symmetrically around the axis, pistons in said cylinders, a common motion transmitting mechanism in said casing, and means linking said pistons to said mechanism, said mechanism including a generally "Z" shaped crankshaft comprising an oblique spindle, and a motion transmitting element, the improvement comprising: the said casing containing the motion transmitting mechanism and carrying the cylinders being composed of at least two parts interconnected along a plane at right angles to the axis of rotation, at least one of the components of the motion transmitting mechanism comprising at least two parts releasably interconnected along a plane at right angles to the axis of the spindle, the motion transmitting element comprising two generally frusto-conical parts and a first generally conical ring gear, a second generally conical ring gear rigid with the casing and in continuous meshing engagement with the first ring gear, and the means linking the pistons to the mechanism comprising a connecting rod associated with each piston, two said connecting rods and their associated pistons being located in a common diametral plane, one of the said connecting rods and one of these pistons being situated at one and the same side of the casing with respect to the central portion of the motion transmitting element.

Preferably the ring gear rigid with the casing is integral with a plane circular ring interposed during assembly between juxtaposed outer flanges of the two parts of the casing.

The large bases of the two frusto-conical parts of the motion transmitting element are preferably joined together by a flat coupling ring which comprises as many bores as there are connecting rods, these bores permitting the securing of spherical insert elements, which form bearings for, and retain, the big ends of the connecting rods.

Preferably the "Z" shaped crankshaft has outer crank webs each having two plane surfaces acting as a bearing or abutment bearer, one of the surfaces being at right angles to the oblique spindle and to the bearing or abutment bearer of the transmitting element, and the other surface being at right angles to the axis of rotation and to an abutment bearing of the casing.

The crankshaft may consist of two parts, the oblique spindle being severed at right angles to its axis, an internal or external central cylindrical element assembled co-axially and without play on each of the two parts re-establishing the continuity after assembly and transmitting the torque.

Preferably at least one of the outer crank webs of the crankshaft is removable at least at one end of the oblique spindle, the detachable web or webs being connected to the end of the spindle during assembly by means of a cylindrical centering element and a clamping tie-rod co-axial with the spindle, in such manner that the whole assembly may withstand flexural and torsional stresses.

The motion transmitting element may consist of three components, namely, a central bi-frustoconical component comprising the coupling ring and the two frusto-conical parts which define a body of revolution about the axis of the element, and terminating in two plane coupling faces at right angles to the axis, and two outer components carrying bearing abutments for the ends of the oblique spindle, each of said outer elements being formed by two half-shells joined together substantially along a plane passing through the axis of the spindle, and connected to the frusto-conical parts at the said coupling faces.

BRIEF DESCRIPTION OF THE DRAWINGS

An embodiment of the invention will now be described, by way of example only, with reference to the accompanying diagrammatic drawings, in which:

FIG. 1 is an axial cross-section of a multi-cylinder engine in accordance with the invention;

FIG. 2 is an elevation partially in section of a modified form of crankshaft of the engine; and FIG. 3 is an axial section of a modified form of a motion transmitting element of the engine.

DESCRIPTION OF THE PREFERRED EMBODIMENTS

The engine shown in FIG. 1 comprises a casing in the form of a body of revolution defined around an axis of rotation 50. The casing is formed by two parts 1 and 2 connected at 3 along a coupling plane 51 at right angles to the axis. Between the two parts 1 and 2 of the casing is interposed a flat ring 4 integral with a ring gear 5 arranged co-axially with respect to the axis 50 and acting as a stationary gear for retention purposes and for transmission of a rotational moment imparted to it by means to be described hereinafter. The parts 1 and 2 comprise flanges 1*a*, 2*a*, on their adjacent extremities, which are joined together by a ring of bolts illustrated by their axis 6, the flat ring 4 being interposed and clamped between the flanges 1*a*, 2*a*.

A bearing housing 7 is arranged on the part 1, co-axially with respect to the axis 50, and a bearing housing 8 is likewise arranged on the part 2, co-axially with respect to the axis 50. Journals at the opposite end portions of a generally "Z" shaped crankshaft 52 rotate in, and bear against, the bearing housings 7 and 8.

The crankshaft 52 comprises a spindle in two halves or parts 9 and 10. The parts 9 and 10 are joined together substantially along the axis 53 of the crankshaft 52 by means of a connecting member 11 which comprises a play-free cylindrical part 12 and torque transmitting splines 13 and 14. The member 11 is secured within partially tapped axial bores 9a and 10a of the juxtaposed end portions of the two parts 9 and 10 of the spindle. In an alternative construction the connecting member 11 may be located externally of the spindle.

At the side of the bearing housing 7 and 8, each spindle part 9 and 10 of the crankshaft 52 comprises a crank web 9b, 10b, which is in the form of an obtuse-angled triangle in radial section, the longest side of the triangle being at right angles to the axis 53 of the crankshaft 52 and the side of the triangle facing away from the axis 53 being at right angles to the axis of rotation 50.

Each crank web 9b, 10b carries on its inner side a bearing or abutment bearer 15 and on its outer side a bearing or abutment bearer 16 against which bear corresponding outer thrust bearers 17 of a motion transmitting element 18 and the bearing housings 7 and 8.

The element 18 is hollow and of bi-frustoconical shape, the extremities of the two frusto-conical parts 20 of the element 18 each terminating in a respective outer thrust bearer 17 formed by a cylindrical portion joined to the small base of the corresponding frusto-conical part and receiving the cylindrical part of the abutment bearer 15 and a portion of the part 9 and 10 of the crankshaft, and in a flange facing the crank web 9b or 10b. The element 18 comprises, in its plane of symmetry, a flat coupling ring 19, positioned co-axially with respect to the axis 53 and to which are connected the large bases of the two frusto-conical parts 20 of the element 18, these parts 20 connecting it to the outer bearers or thrust bearers 17. The coupling ring 19 has bores 21 which are regularly spaced along an annular co-axial surface, and in which are engaged supports 22 and retaining elements 23 for the big ends 54 of connecting rods 25. The supports 22 and the retaining elements 23 for the connecting rods 25 are secured in an appropriate manner to the ring 19.

On its circumference, the ring 19 carries a toothed ring or ring gear 24, positioned co-axially with respect to the axis 53 and in continuous engagement with a part of the stationary gear 5 having an identical tooth pattern.

The connecting rods 25 connect the coupling ring 19 of the element 18 to pistons 26 movable in cylinders 27 which are arranged in equal numbers in each of the two parts 1 and 2 of the housing. The axes of the cylinders 27 are parallel to the axis of rotation 50 and are regularly and symmetrically spaced apart around this axis, a connecting rod and the corresponding piston of one of the parts 1 of the casing being situated in the same radial plane of the axis of rotation 50 as a connecting rod and its corresponding piston of the other part 2 of the casing, the second connecting rod and piston being diametrically opposed to the first connecting rod and piston (see FIG. 1). The forces acting simultaneously on the element 18, are thus substantially largely counterbalanced and the thrust bearings 15 and 16 only receive a small load.

The cylinder heads as well as other elements such as balancing weights have not been illustrated since they are conventional.

A demountable crankshaft 52 is illustrated in FIG. 2. This crankshaft comprises a detachable crank web 28 having a cylindrical center sleeve 29 which is inserted with a tight fit into the bore 30 at the end portion of a hollow cylindrical spindle 31. The crank web 28 is maintained rigid with the spindle 31 by means of an axial tie-rod 32 and nut 33. The tie-rod 32 and its nut 33 are dimensioned in such manner that the flexural and torsional stresses applied to the crank web are borne by the assembly.

The crank web 28' at the end portion of the crankshaft 52 may be of similar construction, the anchoring head of the tie-rod 32 being engaged within a recess of the crank web 28'. In this manner, it is possible to ensure ease of assembly of the crankshaft, and also to impart a predetermined preloading to the crankshaft which will be opposed to the loads to which the said crankshaft will be exposed in operation of the machine.

A motion transmitting element made up of several parts is illustrated in FIG. 3. As shown in this figure frusto-conical parts 34 and 35, terminate at the small base side in the plane annular joint faces 36 and 37 the central diameter of which is such that an outer crank web of the crankshaft spindle may pass therethrough. The parts 34 and 35 are connected symmetrically to the coupling ring 19, the peripheral cross-section of which is substantially T-shaped. The plane annular joint faces 36 and 37 at right angles to the axis of the element carry two detachable end portions 38 and 39 of the element, these end portions comprising the combined radial and axial thrust bearings formed by the elements 15, 17. Each detachable end portion is formed by two half-shells 40 and 41 interconnected along a plane passing substantially through the axis of the element thus rendering it possible to assemble the element on the crankshaft by means of bolts 42 for the plane half-shell joints and by means of screws shown by their axes 43 for the plane annular joints.

It should be noted moreover that the ring gears 5 and 24 have a conical shape the apex coincides with the center 55 of the element 18 and that the centers of all the connecting rod big ends 54 are situated in a plane 56 passing through the said center 55 and at right angles to the axis 53 of the element 18 and of the spindle 52.

The machine particularly described may be produced relatively easily and is reliable in operation in view of the fact that the forces acting on the pistons and the elements coupled thereto are substantially counterbalanced.

What is claimed is:

1. A machine including a casing having first and second sets of cylinders formed therein, said sets of cylinders being located in longitudinally spaced relation to each other and parallel to an axis of rotation with the cylinder in each set being located symmetrically around said axis of rotation, a plurality of pistons respectively located in said cylinders, a common motion transmitting mechanism located in said casing between said first and second sets of cylinders, said motion transmitting mechanism including a generally "Z" shaped crankshaft having a central oblique spindle and axially aligned end extensions rotatably mounted in said casing along said axis of rotation, a motion transmitting element including two generally frusto-conical elements each having major and minor diameter portions and being rotatably mounted on the spindle of the crankshaft, with their major diameter portions adjacent each other, said frusto conical elements of said motion transmitting element comprising at least two frusto conical parts releasably interconnected along their major diameter portions at a plane located at a right angle to said spindle of the crankshaft, and thrust bearings on the ends of said oblique spindle adjacent said end extensions respectively received in the minor diameter portions of said frustro conical parts; means for connecting said pistons to said motion transmitting element; said casing being formed of at least two parts interconnected along a plane located at a right angle to said axis of rotation; a first generally conical ring gear mounted on said motion transmitting element adjacent the major diameter thereof; a second generally conical ring gear rigidly mounted in the casing between the two parts thereof in a plane extending generally perpendicularly to the axis of rotation of said crankshaft and being in continuous mating engagement with said first ring gear, said means for connecting the pistons to said motion transmitting element including a plurality of connecting rods respectively associated with each of said pistons, each of said rods having opposed ends respectively swivelably connected to its associated piston and to said motion transmitting element, each piston in each of said sets being located in a paired relation with a single corresponding piston in the other of said sets, the pistons in each pair being located in a common plane on opposite sides of said transmitting element and 180° away from each other with respect to said axis of rotation, with the slope of said frusto conical parts being selected such that the apex of each frusto conical part lies within its associated thrust bearing and the swivelable connections between said piston rods and said transformer are located along the circle defined by the intersection of said major diameter portions of the frusto conical parts, whereby the forces acting on said crankshaft and casing are substantially counterbalanced and transmitted directly through the movement transformer to the spindle and casing.

2. A machine according to claim 1, wherein the motion transmitting element further comprises a flat rigid coupling ring arranged in a plane of symmetry of the element at right angles to the axis of the element, said coupling ring including bores evenly spaced concentrically around the axis of the element, and a spherical insert located in each bore, each insert being arranged to receive an end portion of a respective connecting rod.

3. A machine according to claim 1, wherein the crankshaft comprises a crank web located at each end of the oblique spindle, each web having two plane surfaces acting as bearing means, one of said surfaces extending at right angles to the axis of the oblique spindle, and the other of said surfaces extending at right angles to the said axis of rotation.

4. A machine according to claim 1, wherein the said frusto-conical parts of the motion transmitting element define a body of revolution about the axis of the element, said body terminating in two plane connecting faces at right angles to the axis of the element, said motion transmitting element further comprising bearing support means connected to said body at each of said connecting faces, each of said bearing support means comprising two half-shells interconnected substantially along a plane passing through the axis of the element.

5. A machine according to claim 4, further comprising radial and axial thrust bearing means for the spindle of the crankshaft, said bearing means being mounted in said bearing support means.

6. A machine including the casing having first and second sets of cylinders formed therein, said sets of cylinders being located in longitudinally spaced relation to each other and parallel to an axis of rotation with the cylinders in each set being located symmetrically around said axis of rotation, a plurality of pistons respectively located in said cylinders, a common motion transmitting mechanism located in said casing between said first and second sets of cylinders, said motion transmitting mechanism including a generally "Z" shaped crankshaft having a central oblique spindle and axially aligned end extensions rotatably mounted in said casing along said axis of rotation, a motion transmitting element including two generally frustro conical elements rotatably mounted on the spindle of the crankshaft, with their major diameter portions adjacent to each other, said frustro conical elements of said motion transmitting element comprising at least two frustro conical parts releasably interconnected along a plane located at a right angle to said spindle of the crankshaft, and means for connecting said pistons to said motion transmitting elements; said casing being formed of at least two parts interconnected along a plane located at right angles to said axis of rotation; and a first generally conical ring gear mounted on said motion transmitting element adjacent the major portion thereof; and a second generally conical ring gear rigidly mounted in the casing between the two parts thereof in a plane extending generally perpendicularly to the axis of rotation of the crankshaft, and being in continuous mating engagement with said first ring gear, said means for connecting the pistons to said motion transmitting element including a plurality of connecting rods respectively associated with each of said pistons, each of said rods having opposed ends respectively swivelably connected to its associated piston and to said motion transmitting element, each piston in each of said sets being located in a paired relation with a single corresponding piston in the other of said sets, the pistons in each pair being located in a common plane on opposite sides of said transmitting element and 180° away from each other with respect to said axis of rotation, whereby the forces acting on said crankshaft and casing are substantially counterbalanced; said spindle comprising two parts, and a torque transmitting connecting member connecting said parts at a plane at right angles to the axis or the spindle.

7. A machine including a casing having first and second sets of cylinders formed therein, said sets of cylinders being located in longitudinally spaced relation to each other and parallel to an axis of rotation with the cylinders in each set being located symmetrically around said axis of rotation, a plurality of pistons respectively located in said cylinders, a common motion transmitting mechanism located in said casing between said first and second sets of cylinders, said motion transmitting mechanism including a generally "Z" shaped crankshaft having a central oblique spindle and axially aligned end extensions rotatably mounted in said casing along said axis of rotation, a motion transmitting element including two generally frustro conical elements rotatably mounted on the spindle of the crankshaft, with their major diameter portions adjacent to each other, said frustro conical elements of said motion transmitting element comprising at least two frustro conical parts releasably interconnected along a plane located at a right angle to said spindle of the crankshaft, and means for connecting said pistons to said motion transmitting elements; said casing being formed of at least two parts interconnected along a plane located at right angles to said axis of rotation; and a first generally conical ring gear mounted on said motion transmitting element adjacent the major portion thereof; and a second generally conical ring gear rigidly mounted in the casing between the two parts thereof in a plane extending generally perpendicularly to the axis of rotation of the crankshaft, and being in continuous mating engagement with said first ring gear, said means for connecting the pistons to said motion transmitting element including a plurality of connecting rods respectively associated with each of said pistons, each of said rods having opposed ends respectively swivelably connected to its associated piston and to said motion transmitting element, each piston in each of said sets being located in a paired relation with a single corresponding piston in the other of said sets, the pistons in each pair being located in a common plane on opposite sides of said transmitting element and 180° away from each other with respect to said axis of rotation whereby the forces acting on said crankshaft and casing are substantially counterbalanced; said crankshaft comprising a crank web located at each end of the oblique spindle, at least one of said webs being detachable, a cylindrical centering element, and a clamping tie-rod, said centering element and said tie-rod acting to detachably secure the detachable web to the spindle.

* * * * *